United States Patent [19]

Ruhle

[11] Patent Number: 4,613,003

[45] Date of Patent: Sep. 23, 1986

[54] APPARATUS FOR EXCAVATING BORE HOLES IN ROCK

[76] Inventor: James L. Ruhle, 2535 E. Balfour Ave., Fullerton, Calif. 92634

[21] Appl. No.: 607,009

[22] Filed: May 4, 1984

[51] Int. Cl.[4] ..... E21B 4/06

[52] U.S. Cl. ..... 175/324; 175/293; 175/417

[58] Field of Search ..... 166/68, 68.5, 105.1, 166/73, 72, 109, 105; 175/26, 56, 67, 324, 293, 389, 414, 401, 421, 189, 135, 417, 418; 173/73, 76, 78, 80

[56] References Cited

U.S. PATENT DOCUMENTS

| | | | |
|---|---|---|---|
| 53,686 | 4/1866 | Saffer | 175/324 |
| 1,145,418 | 7/1915 | Huelsdonk | 175/67 |
| 2,759,705 | 8/1956 | Bjorkman | 175/389 |
| 2,897,768 | 8/1959 | Perry | 166/105 |
| 3,185,227 | 5/1965 | Nelson | 175/243 |
| 3,216,512 | 11/1965 | Grable | 175/171 X |
| 3,603,410 | 9/1971 | Angona | 175/65 |
| 3,674,100 | 7/1972 | Becker | 175/69 |
| 4,024,913 | 5/1977 | Grable | 138/DIG. 7 |
| 4,101,699 | 7/1978 | Stine et al. | 138/DIG. 7 |

FOREIGN PATENT DOCUMENTS

| | | | |
|---|---|---|---|
| 802499 | 2/1981 | U.S.S.R. | 175/54 |

*Primary Examiner*—James A. Leppink
*Assistant Examiner*—Matthew Smith

[57] ABSTRACT

A borehole excavation apparatus and method which employs a down-hole positive displacement pump to circulate the drilling fluid and lift the excavated rock to the surface through nonmetallic composite pipe. The excavation of rock occurs by use of apparatus which produces a combination of percussion impact, cavitation, and hydrostatic depressuring which utilizes the pore pressure and elastic energy stored within the rock to fracture the rock into small pieces. The down-hole positive displacement pump and the excavation tool are actuated by the axial oscillation of a weighted momentum unit which in turn is actuated by the axial oscillation of the nonmetallic composite pipe, which in turn is actuated by the oscillating motion of a rocker beam at the surface where the drilling fluid and excavated rock particles are discharged.

1 Claim, 3 Drawing Figures

29
27
24
10
11
23
30
31
16
18
28
17
12
32
19
34
21
20
22
33
13
15
26
2
2
34
14
19
25
21
3
3
20

APPARATUS FOR EXCAVATING BORE HOLES IN ROCK

BACKGROUND

This invention, describes a completely new approach to drilling oil, gas, and geothermal wells. The technique for excavating the rock involves a novel method of rock disintegration, in combination with a mechanical method of rock disintegration. Both the novel and the mechanical excavation methods exploit the one universal weakness and static parameter of all rocks—namely, their very low tensile strengths. Drilling methods currently in use disintegrate rock for the most part, by overcoming its compressive strength, which unlike tensile strength, increases with confining pressure as the depth of burial increases. Because the tensile strength of rock is only a small fraction of its compressive strength the proposed drilling technique requires only a small fraction of the specific energy required to excavate a unit volume of rock. This makes it possible to reduce the specific power requirements, and to greatly reduce the mass of hardware that is currently required during drilling operations.

SUMMARY OF THE INVENTION

It is among the objects of the invention to provide a new and improved borehole excavation apparatus and process which fractures and excavates rock more efficiently and reduces costs compared with conventional well-drilling methods.

Another object of the invention is to provide a new and improved borehole excavation apparatus and process in which energy is applied at the surface by means of an oscillating rocker beam, and the applied energy is transmitted to the bottom of the borehole by means of axial oscillation, thus eliminating the need for the rotational transmission of energy.

Another object of the invention is to provide a new and improved borehole excavation apparatus and process which employs lightweight composite pipe instead of metallic drill pipe. The composite pipe is reinforced by fibers to provide the necessary strength for such service, the fibers are bonded together by the thermosetting resin matrix which provides the necessary bonding strength for such service, and the composite pipe is mechanically coupled together to provide the necessary strength for such service.

Another object of the invention is to provide a new and improved borehole excavation process which substitutes a low-viscosity drilling fluid, such as water or brine, for conventional drilling muds which have heretofore been commonly in use.

Still another object of the invention is to provide a new and improved borehole excavation process which is capable of maintaining good hole stability; which avoids many of the problems associated with the hydration of clay and shale forming the wall of the borehole; which minimizes the loss of drilling fluid to the formation; which minimizes formation damage; which allows easier entry into the borehole of drilling tools, wireline equipment, and casing; which minimizes the risk of blowouts; and which is of such character tht it will allow more conclusive formation evaluation.

With these and other objects in view, the invention consists in the arrangement and combination of the various process apparatus of the invention, whereby the objects contemplated are attained, as hereinafter set forth, in the appended claims and accompanying drawings.

Figures 1, 2, 3:
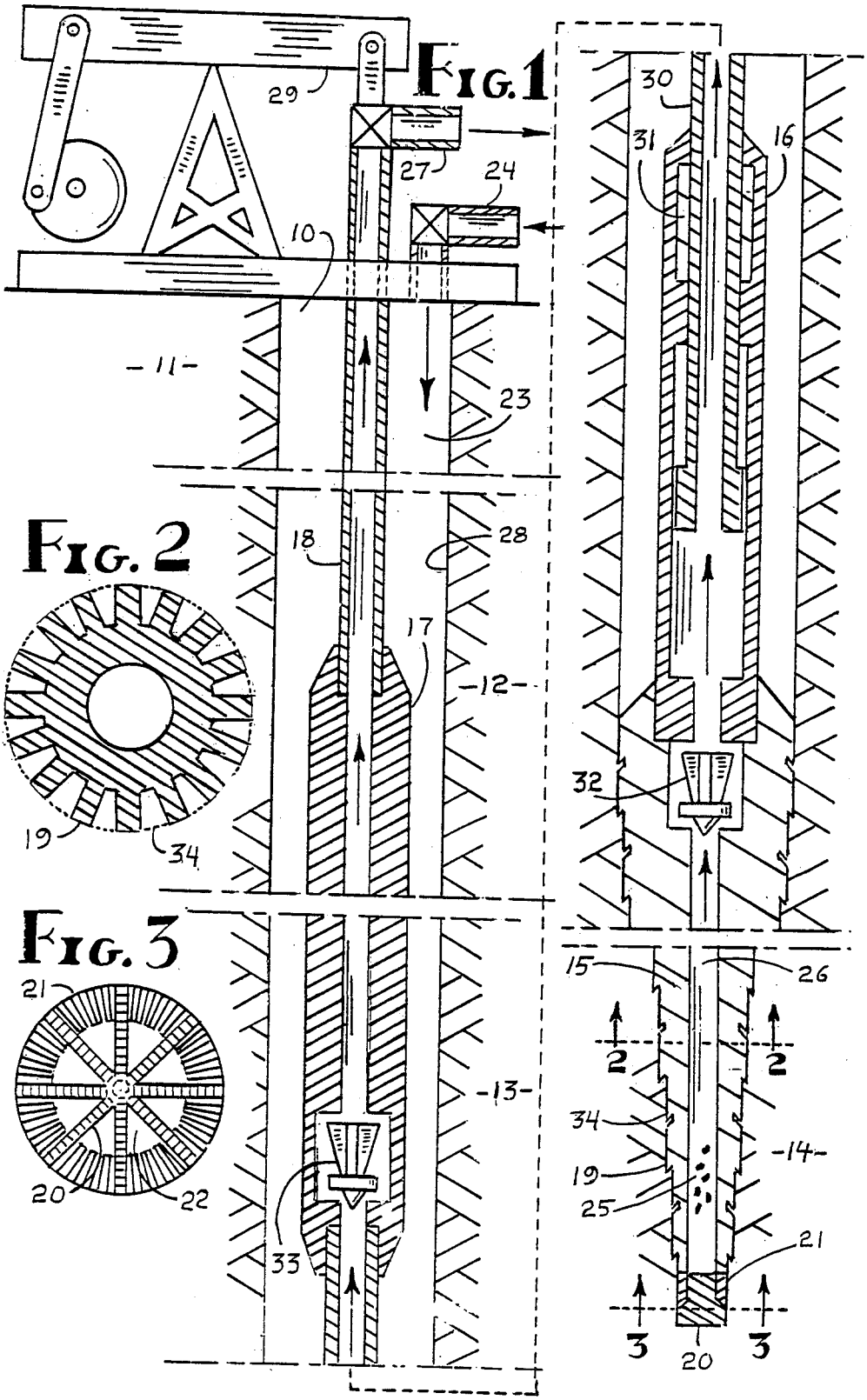
FIG. 1 is a schematic longitudinal sectional view of a drilling operation.
FIG. 2 is an enlarged transverse sectional view on the line 2—2 of FIG. 1.
FIG. 3 is an enlarged transverse sectional view on the line 3—3 of FIG. 1.

Drawing on a typical condition as an example in describing the apparatus and method, it can be assumed that the drilling operation involves drilling an $8\frac{3}{4}$ inch hole making use of 0.4 inch wall composite pipe 2 7/8 inches in outside diameter. The drilling fluid consists of a solution containing dissolved salts, pumped from the bottom of the borehole up through the composite pipe at a velocity of approximately 240 feet per minute. The relative volumes are such that under this circumstance the return flow by gravity of the drilling fluid through the annulus formed between the exterior of the composite pipe and the wall of the borehole will be approximately 16 feet per minute. This process requires that the drilling fluid flow is down the annulus and up the pipe, a process that is the reverse of conventional practice. The process thus employs a clear drilling fluid which can be increased in density by increasing its solution weight with no need to add particulate matter as a weighting material. The solution weight is maintained at a sufficiently high level to control formation pressure, and may vary from the density of fresh water to as high as 19 pounds per gallon. A $9\frac{1}{2}$ pound per gallon calcium chloride brine, for example, has an A.P.I. funnel viscosity of about 32 seconds per 1000 cubic centimeters, which is substantially lower than that of conventional drilling muds which may have A.P.I. funnel viscosities ranging from 90 to 100 seconds.

In using the applicant's technique certain changes in the excavation tool are needed. The changes include the substitution of suction ports for bit nozzles since the drilling fluid is travelling in the opposite direction compared with conventional drilling. The excavated rock is drawn by the drilling fluid, as a result of the down-hole pumping action, through inlet suction ports in the excavation tool, and the drilling fluid is pumped to the surface along with the formation cuttings through the composite pipe. The performance of the excavation tool is such that with each up-stroke of the pump the bottom of the borehole is depressured, which causes the rock and its constituent fluids to expand rapidly because of its stored elastic energy and pore pressure thereby producing a failure of the bottom-hole rock. This tensile stress mode of rock failure requires relatively less energy input compared to crushing the rock by the compressive and shear stress mode employed by conventional drilling methods and is supplemented by the cavitational forces acting upon the rock and by the impact stresses produced by the excavation tool.

In an embodiment of the invention chosen for the purpose of illustration, there is shown in the appended figures a well, 10, which has been excavated by the applicant's method and apparatus through the rock formations 11, 12, 13 and partly into formation 14. The borehole is advanced by employment of an excavation tool, 15, above which is attached the down-hole positive displacement pump, 16. The pump, 16, is stroked and the excavation tool, 15, is oscillated by the axial oscillation of the weighted momentum unit, 17, which in turn is oscillated by the composite pipe, 18. The rock is excavated by a plurality of side-mounted blades, 19, and a plurality of distally-mounted impact blades, 20, in combination with the shoe shut-off, 21, and enters the excavation tool through a plurality of suction ports, 22. A clear drilling fluid, 23, flows by gravity into the well, 10, from a gravity drain, 24, which, after reaching the bottom of the borehole, picks up excavated rock particles, 25, and carries them upward through the central passage, 26, of the excavation tool, 15. The drilling fluid and the excavated rock are pumped to the ground surface through the composite pipe to a discharge conduit, 27, and is collected in a tank (not shown) where the excavated rock is separated.

The drilling fluid is a clear fluid without an appreciable amount of solid particles. The clear drilling fluid flows down into the well through the annulus formed between the exterior of the composite pipe, 18, and the bare borehole wall, 28, so that only hydrostatic pressure is applied to the annulus. Since the annulus pressure is therefore much less than that applied in conventional drilling practices there is less risk of formation breakdown and subsequent loss of large amounts of drilling fluid to the exposed formations in the borehole.

The composite pipe, 18, is oscillated at the surface by the rocker beam, 29. The center of the pump, 16, is occupied by a movable hollow plunger, 30, which passes through the seal, 31, which prevents leakage between the hollow plunger, 30, and the outer part of the pump, 16, as the former strokes back and forth within the latter. During the upstroke of the movable hollow plunger, 30, the standing valve, 32, opens, and the travelling valve, 33, closes, whereas during the downstroke of the hollow plunger, 30, the standing valve, 32, closes, and the travelling valve, 33, opens.

During the upstroke of the movable hollow plunger, 30, the hydrostatic pressure created by the clear drilling fluid, 23, beneath the shoe shut-off, 21, is reduced considerably with the aid of the sealing action created by the shoe shut-off, 21. This reduction in hydrostatic pressure releases the compressive elastic energy and the pore pressure within the rock at the bottom of the borehole, thus allowing it to fracture by tensile failure resulting from the expansive stresses stored within the rock.

At the termination of the upstroke of the movable hollow plunger, 30, when the excavation tool is lifted off bottom the annular pressure is suddenly restored to the bottom of the borehole, which allows the rock also to be subjectd to cavitational forces as a result of the impacting drilling fluid.

The cyclic compression and decompression at the bottom of the borehole, in concert with the cyclic and coordinated operation of the standing valve, 32, and the travelling valve, 33, results in the upward displacement of the clear drilling fluid, 23, and the excavated rock particles, 25, through the suction ports, 22, through the central passage ways of the shoe shut-off, 21, and the excavator, 15, through the standing valve, 32, through the inside of the pump, 16, and its movable hollow plunger, 30, through the weighted momentum unit, 17, through the composite pipe, 18, and through the discharge conduit, 27, at the surface.

The side-mounted blades, 19, are positioned on the excavator, 15, in groups, or a plurality of stages, with each stage excavating a specific borehole diameter which increases in the direction of the pump, 16. Each stage is also equipped with a second set of side-mounted blades, 34, which are identical to the side-mounted blades, 19, within each stage, but are offset by one blade width with respect to the side-mounted blades, 19, so that their cutting paths will excavate that part of the rock formation left between the longitudinal kerfs excavated by the side-mounted blades, 19, within each stage. The second set of side-mounted blades, 34, within each stage is indicated by the dashed lines in FIG. 2.

The rock particles excavated by the side-mounted blades then fall to the bottom of the borehole where they are then drawn through the suction ports, 22, along with the rock particles excavated from the bottom of the borehole, and then pumped to the surface. The shut-off valve, 35, controls the flow through the discharge conduit, 27, whereas the shut-off valve, 36, controls the flow through the gravity drain, 24.

The shoe shut-off, 21, is situated at the lowermost, or distal end of the excavation tool, 15, and unlike the latter, contains no side-mounted blades. The outside diameter of the smooth outer cylindrical surface of the shoe-shut-off, 21, is less than the outside edge diameter of the side-mounted blades immediately above it, whereas the outer side edges of the distally-mounted impact blades, 20, below the shoe shut-off, 21, do not extend beyond the outer cylindrical surface of the shoe shut-off, consequently, as the shoe shut-off advances through the rock formation behind the forward, or distally-mounted impact blades, 20, the smooth cylindrical surface of the shoe shut-off, 21, fits tightly within the cylindrical seat in the rock formation at the bottom of the borehole, thus creating the annular sealing action, which is enhanced by bottom-hole mud produced by the formation cuttings raining down from the side-mounted blades above.

The annular sealing action of the shoe shut-off, 21, takes place during the lower part of the up-stroke of the weighted momentum unit, 17, while the pump, 16, is being up-stroked during its suction stroke, and the shoe shut-off, 21, is seated at the bottom of the borehole, whereas cavitation takes place during the upper part of the up-stroke of the weighted momentum unit, 17, when the shoe shut-off, 21, is lifted out of its seat at the bottom of the borehole, which breaks the annular seal, and allows the annular fluid to impact the decompressed region at the bottom of the borehole, thus driving a shock wave into the rock, and restoring full annular hydrostatic pressure to the bottom of the borehole.

Circulation of the drilling fluid, with its load of formation cuttings, also takes place across the bottom of the borehole when the shoe shut-off, 21, is lifted out of its seat at the bottom of the borehole, thus allowing fluid flow to take place from the annulus to, and up through the suction ports, 22, up through the central passage, 26, up through the lower valve, or standing valve, 32, and into the lower part of the pump, 16, as a result of the decompression, or suction, below the movable tubular hollow plunger, 30, created during the up-stroke of the pump, 16, just before the shoe shut-off was lifted out of its seat at the bottom of the borehole.

During the down-stroke of the weighted momentum unit, particularly, during the lower part, when the pump, 16, is down-stroked and the shoe shut-off, 21, is seated at the bottom of the borehole, the drilling fluid and its load of formation cuttings are forced up through the movable tubular hollow plunger, 30, up through the upper valve, or travelling valve, 33, up through the weighted momentum unit, 17, and up through the composite pipe, 18, as a result of the compression below the movable tubular hollow plunger, 30, during the downstroke of the pump, 16.

It is during the up-stoke, or suction stroke of the pump, 16, that the rock at the bottom of the borehole is subjected to internal expansive stresses resulting from the hydrostatic decompression of the drilling fluid, or hydraulic unloading, which allows the formation pressure stored within the rock to express itself, and subject the rock to tensile loads caused by pore fluid expansions within the rock and elastic rebound of the rock matrix itself. Since the tensile strength of rock is only a small fraction of its compressive strength or shear strength the rock at the bottom of the borehole can be made to fail of fracture with greater ease than if it were subjected to compressive or shear loads, whereas the shock waves from the alternate, or low-frequency cavitation of the rock at the bottom of the borehole in concert with the stroking action of the weighted momentum unit, 17, also subject the rock to additional stress, as does the gravity impact of the distally-mounted impact blades, 20.

Since no suspended solids are added to the drilling fluid, and since the circulation of the drilling fluid is down the annulus and up through the composite pipe, there is little, if any filter cake on the borehole wall, which otherwise might cause differential sticking of the pipe and interfere with running drilling tools, wire-line equipment or casing into the hole. The resulting absence of a mud cake, combined with the use of a clear low-viscosity drilling fluid greatly reduces pressure surges when running the drilling tools into the hole and greatly reduces the risk of formation breakdown. Thus, the permeation of drilling fluid into the exposed formations is more uniform and more predictable than it would be if drilling fluid were lost to the formation through induced fractures as a result of formation breakdown.

When using solution weight to control formation pressure, a solution is produced which has an ionic concentration greater than that of formation water. This creates a condition which prevents the passage of water from the drilling fluid to the formation clay and shale, thus eliminating the problem associated with the hydration of clay and shale when drilling with mud by conventional means. Avoiding the use of mud and the concomitant employment of suspended solids reduces formation damage by minimizing the mudding-off of producing zones as well as greatly reducing drilling fluid viscosity. The use by this process of a low viscosity drilling fluid reduces the swabbing effect when withdrawing the drilling tools from the borehole and thereby minimizes a common cause of blow-outs.

By employing a clear low-viscosity drilling fluid it is easier to detect formation hydrocarbons in the drilling fluid since no oil is added to the drilling fluid, as is a common practice when drilling with mud systems. This process eliminates the problem where oil shows of higher fractions become emulsified in the viscous drilling muds and defy detection by mud loggers. The low-viscosity turbulently-flowing drilling fluid used in the method of this invention can lift relatively large formation cuttings up through the inside of the relatively-small diameter composite pipe, and makes possible a more conclusive evaluation of each formation penetrated.

Having described examples of employing the present invention, I claim:

1. A borehole excavation apparatus having a passageway therethrough comprising:

a rocker beam with connecting means suitable for supporting and vertically oscillating a pipe for drilling a borehole, said pipe being nonmetallic composite pipe, a cylindrical weighted momentum unit supported by and coupled to the bottom of said composite pipe, a downhole positive displacement pump having top and bottom portions with means for connecting the pump to said cylindrical weighted momentum unit, said pump comprising a housing, a movable tubular plunger disposed inside said housing, seal means disposed inside said housing at the top portion of and circumferentially around said plunger, a standing valve in said passageway and disposed adjacent to said bottom portion, a travelling valve in said passageway disposed above said standing valve, an excavation tool with means for connecting to said downhole positive displacement pump, said tool comprising an array of side-mounted blades, a distally-mounted tubular shoe shut-off connected to said tool at the bottom end thereof, an array of distally-positioned suction ports through said shoe shut-off, and an array of distally-mounted impact blades on said shoe, said passageway conveying drilling fluid and excavated rock chips upward through the excavation tool upon operation of said apparatus.

* * * * *